US005261974A

United States Patent [19]

Hyodo et al.

[11] Patent Number: 5,261,974

[45] Date of Patent: Nov. 16, 1993

[54] HIGH-STRENGTH EXTRA FINE METAL WIRE

[75] Inventors: Kenji Hyodo, Ono; Ichiro Nagao, Kobe, both of Japan

[73] Assignee: Tokusen Kogyo Company Limited, Hyogo, Japan

[21] Appl. No.: 910,502

[22] Filed: Jul. 8, 1992

[30] Foreign Application Priority Data

Jul. 8, 1991 [JP] Japan ..... 3-194753

[51] Int. Cl.[5] ..... C21D 8/06; C21D 9/52

[52] U.S. Cl. ..... 148/320; 148/598; 148/599

[58] Field of Search ..... 428/606; 148/598, 599, 148/320

[56] References Cited

U.S. PATENT DOCUMENTS

| | | | |
|---|---|---|---|
| 3,584,494 | 6/1971 | Geipel et al. | 148/599 |
| 3,647,571 | 3/1972 | Okamoto et al. | 148/599 |
| 3,900,347 | 8/1975 | Lorenzetti et al. | 148/599 |
| 4,017,338 | 4/1977 | Kozak et al. | 148/599 |
| 4,142,919 | 3/1979 | Maiffredy et al. | 145/599 |
| 4,754,806 | 7/1988 | Dambre | 148/599 |
| 4,889,567 | 12/1989 | Fujiwara et al. | 148/598 |
| 5,156,692 | 10/1992 | Tsukamoto | 148/598 |
| 5,162,727 | 12/1992 | Kim et al. | 148/599 |

FOREIGN PATENT DOCUMENTS

| | | | |
|---|---|---|---|
| 241089 | 11/1986 | German Democratic Rep. | 148/599 |
| 53-5245 | 2/1978 | Japan | 148/598 |
| 53-131219 | 11/1978 | Japan | 148/598 |
| 58-164731 | 9/1983 | Japan | 148/598 |
| 58-207325 | 12/1983 | Japan | 148/599 |
| 61-3836 | 1/1986 | Japan | 148/598 |

*Primary Examiner*—John Zimmerman

*Attorney, Agent, or Firm*—Wenderoth, Lind & Ponack

[57] ABSTRACT

A high-strength extra fine metal wire of a diameter of 0.01–0.50 mm containing 0.60 wt %–1.20 wt % carbon, consisting of a metal structure in the form of bundle of said carbides and presenting a shape about rectangular or circular in which the ratio of the length in the longitudinal direction to the length in the direction of width in the cross section is no more than 2.5 and the mean sectional area is no more than $150\times10^{-4}$ $\mu m^2$, and improving strength and tenacity by having a tensile strength of 300 kgf/mm$^2$ or over.

2 Claims, 2 Drawing Sheets

HIGH-STRENGTH EXTRA FINE METAL WIRE

BACKGROUND OF THE INVENTION

The present invention relates to a high-strength extra fine metal wire with high tenacity to be used for rubber reinforcement of tire cord, belt cord, etc., plastic reinforcement, material for electromagnetic wave shield, needle material, wire saw, precision spring, wire rope, miniature rope, angling thread, etc.

Generally, extra fine metal wire is used in various modes depending on its uses: by twisting a plural number of pieces together, by weaving, in the state of single wire, by cutting in short pieces, etc.

By the way, the properties requested of extra fine metal wire are the possibility of finishing in an extra fine diameter, sufficiently high strength and toughness for resisting uses in the said fields of utilization, excellent workability in drawing and twisting, reasonable cost, etc.

However, conventional extra fine metal wires are usually manufactured through several times of cold wire drawing while preventing a drop of tenacity of wire rod in each wire drawing by submitting hot rolled material (high carbon steel wire rod generally) to several times of patenting during the processing.

For that reason, a lot of manufacturing processes were required with the prior art and the manufacturing cost was rather expensive. Moreover, patenting of extra fine metal wire is technically difficult because of the difficulty of temperature control, and the drawing strain was also limited because of wire breaking, etc. Furthermore, the true strain in the said cold wire drawing was 2.30–3.50 or so at the maximum (true strain $\epsilon=2\ln Do/Df$, Do: Wire diameter before wire drawing, Df: Finished wire diameter) and the finished extra fine metal wire usually had a strength of 300 kgf/mm$^2$ or under in tensile strength and a wire diameter of 0.15 mm or over.

A steel wire having a tempered martensite structure submitted to hardening and tempering by heat treatment is also known to the public. This steel wire is submitted to wire drawing, etc. by reducing the strength with tempering because it is a wire rod of a comparatively large diameter and cannot provide a good drawability in the hardened state. However, it is rarely utilized in the aid fields of service because it is not an extra fine metal wire of high strength.

In addition, steel wire of a diameter of 1 mm or over having a proper level of strength and tenacity in the tempered state as oil-tempered wire is also used in a large quantity. This steel wire is prepared by oil tempering, etc. because it is poor in tenacity although it has excellent hardness and strength.

Namely, with the prior art, there were such problems that a hardened steel wire is fragile and poor in tenacity and a steel wire submitted to hardening and tempering has an improved tenacity but is difficult to control on heat treatment and its strength may sharply drop depending on the way of tempering. For that reason, wire drawing of a wire rod of patenting structure has so far been considered as the best way for obtaining a high-strength fine metal wire of excellent tenacity and best drawability from a high carbon steel wire rod.

These days, however, with the progress of technology, it has become difficult to sufficiently meet the required quality with an extra fine wire obtained by this wire drawing with patenting, and there is now a request for a high-strength extra fine metal wire of good productivity which not only is rectangular in wire diameter but also maintains a high strength and a high tenacity and is suitable for wire drawing.

By the way, a hardened steel wire has a martensite structure and can hardly be submitted to cold working. Moreover, a steel wire of large diameter is known to improve in strength and proof stress. However, this steel wire has poor drawability with a true strain of 0.69 or so and its tenacity is also not so high with a tensile strength of 250 kgf/mm$^2$ or so. This is probably because of an influence of its metal structure or roughing of carbide and dispersion in size, etc., according to the observation of this inventor.

Moreover, it is patenting which has so far been considered as the best means of obtaining a high-strength fine metal wire thanks to good drawability. It is a well known fact that this pearlite structure by patenting is a lamellar structure of ferrite and cementite. And its drawability has been believed to be excellent because this cementite is lamellar. Indeed, an extra fine wire of pearlite structure is submitted to wire drawing with a true strain of 3.3 or so. However, the said cementite is about flat in shape as it appears in the micrographic structure and its cross section is rectangular in shape. For that reason, if you make a wire drawing of a higher drawing strain, the wire cracks with interference among its cementite layers, producing breaking, etc. (drawing limit). The drawing limit is about 3.5 in true strain at the best. At a higher drawing strain, breaking of wire often takes place during the wire drawing and the tenacity also suddenly drops, making it impossible to further improve its strength.

The present invention aims at sharply improving the drawability of a wire of a certain chemical composition as well as the strength and tenacity in the state of extra fine metal wire by performing quenching and tempering properly and by controlling the metal structure of the extra fine metal wire obtained by wire drawing at a constant level.

With the high-strength extra fine metal wire of the present invention, it has become possible to perform wire drawing with a true strain of 4.0–4.7 or so and to sharply improve the strength and tenacity of the wire by eliminating interference among the carbides appearing in the micrographic structure thanks to adoption of an about rectangular or circular shape in which the shape of the section is restricted.

Moreover, the high-strength extra fine metal wire of the present invention has a wide variety of applications and a high value of utilization because it has high strength, high tenacity and excellent fatigue resistance which could never be obtained with any conventional metal wire, although it is made of a conventionally used carbon steel wire rod. Moreover, excellent drawability makes it possible to secure a high degree of processing and to also reduce the number of dies in the heat treatment process or wire drawing during the working. The effects of this invention are really remarkable.

SUMMARY OF THE INVENTION

The inventor et al. repeated careful studies on the workability in wire drawing as well as the strength, tenacity, etc. after wire drawing of pearlite, martensite, sorbite, tempered martensite, etc. which are micro structure obtained by conventional patenting, quenching and quenching and tempering. As a result, we recognized the great influence of the metal structure on the drawability, strength, tenacity, etc. of the material and that, especially in fine wire of carbon steel, it is possible to obtain a high-strength extra fine metal wire better than the conventional extra fine wire by patenting by maintaining the metal structure of the wire in a constant state with precise quenching or quenching and tempering, and finally succeeded in achieving this invention.

Namely, the high-strength extra fine metal wire of the present invention is a metal wire of a diameter of 0.01–0.50 mm containing 0.60%–1.20% carbon in weight and its metal structure has the form of a bundle of slender carbides. The wire has a shape about rectangular or circular in which the shape of the carbide in the cross section is $l/w \leqq 2.5$, $S \leqq 150 \times 10^{-4}$ $\mu m^2$. The tensile strength of the wire is no less than 300 kgf/mm$^2$.

Moreover, the high-strength extra fine metal wire of the present invention consists of a structure obtained by submitting a tempered martensite structure to wire drawing.

Furthermore, the high-strength extra fine metal wire of the present invention has an about circular form in which no less than 90% of carbides have a length of $800 \times 10^{-4}$ $\mu m$ (=800 Å) or under in the direction of width in the cross section and may sometimes have a tensile strength of 350 kgf/mm$^2$ or over.

By the way, the said carbides all have a slender shape and present an about rectangular or circular shape in the cross section. The said shape of carbides is, in the carbides of about rectangular shape, the shape of cross section in a section perpendicular to the longitudinal direction of that rectangular shape and, in the above formula, l is the length of the carbide in the longitudinal direction, w is the length of the carbide in the direction of width and S is the mean sectional area of the carbide.

The reason why the carbon content in the present invention was set at 0.60–1.20 wt % is that this is necessary for the extra fine metal wire to have a certain fine fibrous structure after wire drawing and also to have high strength and high tenacity. If the carbon content is lower than 0.60 wt %, the material cannot obtain sufficient martensite in hardening and becomes low in strength. If, on the contrary, the carbon content is higher than 1.20 wt %, the material cannot obtain the desired fine fibrous structure, gets poor in tenacity even if it has a high strength and becomes unfit for wire drawing.

Moreover, the reason why the ratio of the length in the longitudinal direction to the length in the direction of width l/w in the shape of carbide in the metal structure has been set at no more than 2.5 is that this is necessary for obtaining the desired drawability, strength and tenacity.

Furthermore, if the mean sectional area S of the carbide is larger than $150 \times 10^{-4}$ $\mu m^2$, wire drawing becomes difficult and it is also disadvantageous from the viewpoint of strength and tenacity.

In addition, by having no less than 90% of carbides in an about circular shape of a length of $800 \times 10^{-4}$ $\mu m$ (=800 Å) or under in the direction of width, it is possible to sharply improve the reduction of area in wire drawing and to obtain a high-strength extra fine metal wire.

EXAMPLE 1

Figure 1:
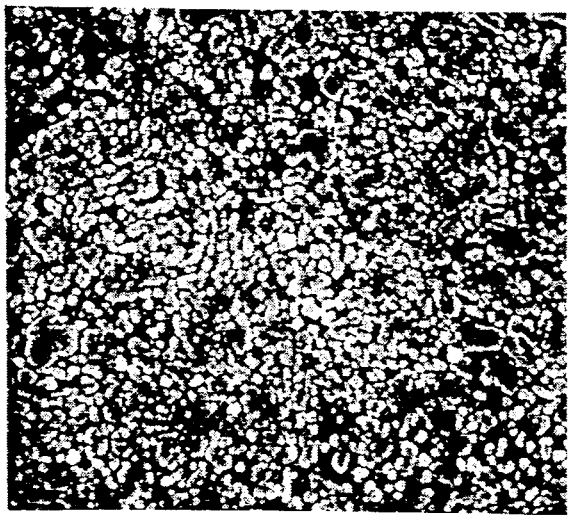
FIG. 1 is an electron microphotograph of magnification 20,000 indicating the metal structure in the cross section of a high-strength extra fine metal wire which is an example of the present invention.

An example of the present invention will be explained together with a reference example and a conventional example. The steel wire rods used here are 5 different kinds of wire rod equivalent to ordinary hard steel wire rods or piano wire rods with variable carbon contents as shown in Table 1.

TABLE 1

| Steel wire rod No. | Chemical composition (wt %) | | | | |
|---|---|---|---|---|---|
| | C | Si | Mn | P | S |
| 1 | 0.52 | 0.21 | 0.89 | 0.008 | 0.005 |
| 2 | 0.61 | 0.25 | 0.85 | 0.010 | 0.009 |
| 3 | 0.70 | 0.21 | 0.87 | 0.005 | 0.004 |
| 4 | 0.82 | 0.20 | 0.49 | 0.004 | 0.003 |
| 5 | 1.12 | 0.20 | 0.50 | 0.005 | 0.002 |

By using the above wire rods, we examined their metal structure, etc. by changing the conditions of preliminary wire drawing before final wire drawing and of final heat treatment in various ways as shown in Table 2. Table 3 indicates the results of this study.

TABLE 2

| Experiment No. | No. of wire rod | Heat treatment in previous process | Preliminary wire drawing | | Conditions of final heat treatment | | | | |
|---|---|---|---|---|---|---|---|---|---|
| | | | | | Heating | | | Tempering | |
| | | | Reduction of area % | Finished diameter mm | Temperature °C. | Time sec. | Hardening Liquid | Temperature °C. | Time sec. |
| 1 | 1 | Patenting | 70.5 | 0.38 | 830 | 35 | Oil | 450 | 22 |
| 2 | 2 | " | 75.0 | 0.35 | 830 | 30 | " | 400 | 20 |
| 3 | 2 | " | 82.6 | 1.25 | 820 | 55 | " | 450 | 37 |
| 4 | 2 | " | 49.0 | 0.50 | 800 | 41 | " | 340 | 28 |
| 5 | 2 | " | 81.6 | 0.30 | 800 | 28 | " | 350 | 19 |
| 6 | 3 | " | 88.9 | 1.0 | 830 | 50 | " | 400 | 33 |
| 7 | 3 | " | 92.0 | 0.85 | 830 | 50 | " | 420 | 33 |
| 8 | 3 | " | 95.4 | 0.15 | 800 | 12 | " | 400 | 8 |
| 9 | 4 | " | 80.0 | 1.35 | 840 | 55 | " | 430 | 37 |
| 10 | 4 | " | 92.9 | 0.8 | 830 | 50 | " | 490 | 33 |
| 11 | 4 | " | 53.0 | 0.48 | 830 | 40 | " | 450 | 30 |
| 12 | 5 | " | 86.6 | 1.10 | 840 | 53 | " | 450 | 35 |
| 13 | 5 | " | 58.7 | 0.45 | 830 | 40 | " | 420 | 27 |

TABLE 2-continued

| Experiment No. | No. of wire rod | Heat treatment in previous process | Preliminary wire drawing: Reduction of area % | Preliminary wire drawing: Finished diameter mm | Conditions of final heat treatment: Heating: Temperature °C. | Heating: Time sec. | Hardening Liquid | Tempering: Temperature °C. | Tempering: Time sec. |
|---|---|---|---|---|---|---|---|---|---|
| 14 | 5 | " | 75.0 | 0.35 | 830 | 30 | " | 490 | 20 |
| 15 | 3 | " | 88.9 | 1.0 | 950 | 30 | (Lead) | (550) | (15) |
| 16 | 4 | " | 75.0 | 1.5 | 950 | 40 | (Lead) | (550) | (20) |
| 17 | 3 | " | 60.9 | 2.5 | 920 | 120 | Oil | 460 | 80 |
| 18 | 4 | " | 57.8 | 2.6 | 920 | 120 | " | 430 | 80 |

*In the Table, the conditions given in ( ) of experiments Nos. 15, 16 are the patenting conditions.

TABLE 3

| Experiment No. | After heat treatment: Metal structure | Shape of carbide (Shape of cross section): Mean l × w Å | Mean l/w | Mean section area $\mu m^2$ | Tensile strength kgf/mm² |
|---|---|---|---|---|---|
| 1 | Tempered martensite | 2000 × 700 | 2.86 | $140 \times 10^{-4}$ | 122 |
| 2 | " | 950 × 680 | 1.40 | $65 \times 10^{-4}$ | 128 |
| 3 | " | 1550 × 700 | 2.21 | $109 \times 10^{-4}$ | 128 |
| 4 | " | 1800 × 700 | 2.57 | $126 \times 10^{-4}$ | 186 |
| 5 | " | 1050 × 700 | 1.50 | $74 \times 10^{-4}$ | 188 |
| 6 | " | 1000 × 720 | 1.39 | $72 \times 10^{-4}$ | 175 |
| 7 | " | 1000 × 650 | 1.54 | $65 \times 10^{-4}$ | 165 |
| 8 | " | 950 × 700 | 1.36 | $67 \times 10^{-4}$ | 170 |
| 9 | " | 1000 × 700 | 1.43 | $70 \times 10^{-4}$ | 183 |
| 10 | " | 1200 × 700 | 1.71 | $84 \times 10^{-4}$ | 158 |
| 11 | " | 800 × 680 | 1.18 | $54 \times 10^{-4}$ | 170 |
| 12 | " | 1400 × 700 | 2.00 | $98 \times 10^{-4}$ | 205 |
| 13 | " | 1050 × 700 | 1.50 | $74 \times 10^{-4}$ | 235 |
| 14 | " | 1000 × 730 | 1.37 | $73 \times 10^{-4}$ | 190 |
| 15 | Pearlite | 2500 × 700 | 3.57 | $175 \times 10^{-4}$ | 125 |
| 16 | " | 2300 × 650 | 3.54 | $150 \times 10^{-4}$ | 138 |
| 17 | Tempered martensite | 3500 × 870 | 4.02 | $304 \times 10^{-4}$ | 115 |
| 18 | " | 3000 × 800 | 3.75 | $240 \times 10^{-4}$ | 123 |

After that, we performed wire drawing by selecting the degree of drawing strain in the final wire drawing as required, and then observed and measured the metal texture, etc. in the cross section of the fine metal wire obtained. Table 4 indicates the results of this measurement.

TABLE 4

| Experiment No. | Final wire drawing: Finished wire diameter mm | True strain | Drawability | Critical drawing strain | Shape of carbide after final wire drawing (Shape of cross section): Mean l × w Å | Mean l/w | Mean sectional area $\mu m^2$ | Percentage of shape A % |
|---|---|---|---|---|---|---|---|---|
| 1 | 0.10 | 2.67 | ○ | 4.61 | 1100 × 700 | 1.57 | $77 \times 10^{-4}$ | 78 |
| 2 | 0.05 | 3.89 | ○ | 4.61 | 950 × 700 | 1.36 | $67 \times 10^{-4}$ | 92 |
| 3 | 0.20 | 3.67 | ○ | 4.51 | 1570 × 670 | 2.34 | $105 \times 10^{-4}$ | 67 |
| 4 | 0.15 | 2.41 | ○ | 4.61 | 1850 × 700 | 2.64 | $130 \times 10^{-4}$ | 35 |
| 5 | 0.03 | 4.61 | ○ | 4.71 | 1100 × 700 | 1.57 | $77 \times 10^{-4}$ | 84 |
| 6 | 0.20 | 3.22 | ○ | 4.60 | 1000 × 700 | 1.43 | $70 \times 10^{-4}$ | 90 |
| 7 | 0.10 | 4.28 | ○ | 4.75 | 1000 × 700 | 1.43 | $70 \times 10^{-4}$ | 93 |
| 8 | 0.02 | 4.03 | ○ | 4.20 | 950 × 700 | 1.30 | $67 \times 10^{-4}$ | 95 |
| 9 | 0.25 | 3.37 | ○ | 4.15 | 1000 × 700 | 1.43 | $70 \times 10^{-4}$ | 92 |
| 10 | 0.15 | 3.35 | ○ | 4.70 | 1200 × 750 | 1.60 | $90 \times 10^{-4}$ | 70 |
| 10 | 0.05 | 4.52 | ○ | 4.70 | 800 × 650 | 1.23 | $52 \times 10^{-4}$ | 97 |
| 12 | 0.30 | 2.60 | ○ | 4.13 | 1200 × 700 | 1.70 | $84 \times 10^{-4}$ | 80 |
| 13 | 0.09 | 3.20 | ○ | 4.02 | 1050 × 750 | 1.40 | $79 \times 10^{-4}$ | 90 |
| 14 | 0.05 | 3.89 | ○ | 4.20 | 1050 × 730 | 1.44 | $77 \times 10^{-4}$ | 94 |
| 15 | 0.20 | 3.22 | ○ | 3.44 | 2500 × 650 | 3.85 | $163 \times 10^{-4}$ | 18 |
| 16 | 0.32 | 3.09 | ○ | 3.24 | 2300 × 650 | 3.54 | $152 \times 10^{-4}$ | 23 |
| 17 | 1.75 | 0.71 | Δ | 0.80 | 2200 × 850 | 2.59 | $187 \times 10^{-4}$ | 32 |
| 18 | 1.50 | 1.10 | × | 0.65 | 2100 × 800 | 2.63 | $168 \times 10^{-4}$ | 25 |

(The specimens of) experiments Nos. 1-14 were all manufactured by submitting various fine wires of a diameter of 0.15-1.35 mm to heat treatment by changing the temperature and time of hardening and tempering. In the table, experiments Nos. 1, 2, 4 indicate reference examples while experiments Nos. 3, 5-14 represent examples of the present invention. Experiments Nos. 15-18 indicate conventional examples, Nos. 15 and 16 representing examples submitted to conventional patenting and Nos. 17, 18 representing those manufactured by performing a heat treatment to the conventional oil-tempered wires which are generally used as spring materials.

Tempered martensite texture in the metal structure before final wire drawing is a structure obtained by heating a wire rod submitted to wire drawing in the previous process at a temperature no lower than the $A_1$ transformation point (approx. 750° C.–850° C. in this experiment) into austenite, changing it completely into martensite after that with quenching (oil quenching or water quenching in this experiment) and then submitting it to tempering at a temperature no higher than the $A_1$ transformation point (approx. 300° C.–550° C. in this experiment).

Pearlite structure (fine pearlite structure to be more exact) is obtained by patenting which is a kind of isothermal transformation widely adopted for this type of wire rod. It is a structure consisting of alternate lamellar sheets of ferrite obtained by heating (the wire rod) at approximately 900° C.–1,000° C. and cementite and then submitting it to hot bath quenching at about 550° C. by using a melting metal such as lead, etc. or melting salt as a cooling medium.

Critical drawing strain in final wire drawing is the drawing strain estimated as possible in manufacture judging from the drawability in final wire drawing and is expressed with true strain $\epsilon=21$ n Do/Df.

Shape of carbide indicates the shape of cross section of about rectangular or circular carbides in the tempered martensite structure. A tempered martensite structure has a random arrangement of carbides in which the structure is in a somewhat collapsed state. It was rather difficult to check the shape of cross section of each carbide in this state but we judged this shape by taking a large number of microscopic photos continuously in the longitudinal direction.

Shape of carbide after final wire drawing is the shape of carbide appearing on the microscope in the metal structure in the cross section. In that case, the carbides differ from the carbides after heat treatment in the way of arrangement: while the carbides after heat treatment and before final wire drawing as arranged at random as mentioned before, those after final wire drawing converge in one direction (direction of wire drawing). For that reason, in the extra fine metal wire of the present invention, all shapes of the carbides in the metal structure in the cross section are equal to the shape of cross section of the carbides.

The shape of the said carbides is not uniformly rectangular but is often curved. In the case of curved carbides, the length of carbide was determined as the length obtained by straightening the curved carbide.

As for the distinction between longitudinal direction and direction of width of the carbides, the longer or wider side was named as length in longitudinal side 1 and the shorter or narrower side as length in direction of width w. The shape of carbides was named as about circular if the 1/w ratio is about 1.5 or under and as about rectangular if this ratio is larger than above. Moreover, the shape of a carbide with a length in the direction of width of $800\times10^{-4}$ μm (=800 Å) or under and a 1/w ratio no more than 1.5 was indicated as shape A. Rate of occupation means the percentage of the shape A against the entire area (of the metal).

Figure 2:
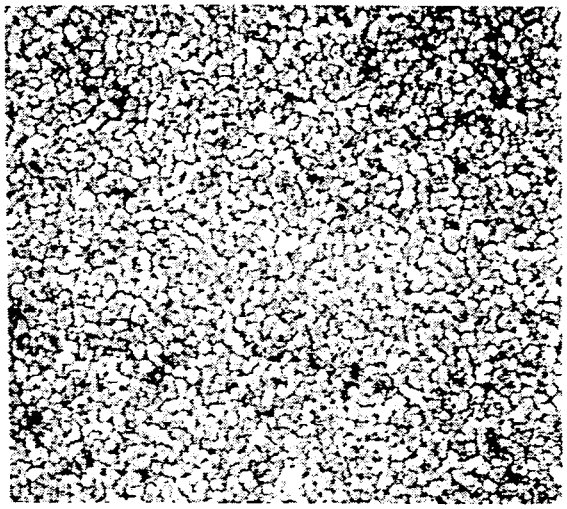
FIG. 2 is an electron microphotograph of magnification 20,000 indicating the metal structure in the cross section of a high-strength extra fine metal wire which is another example of the present invention.
Figure 3:
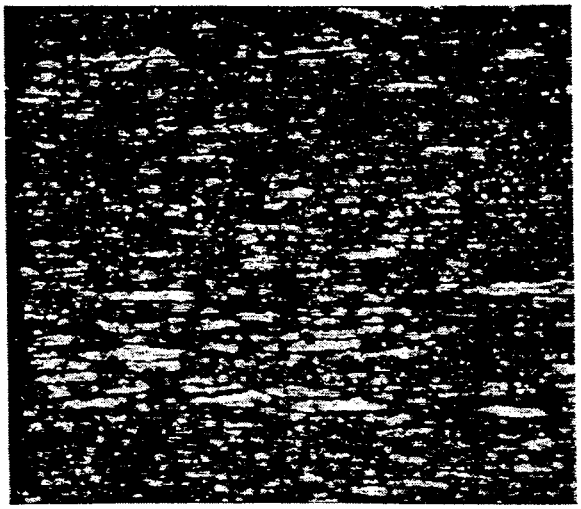
FIG. 3 is an electron microphotograph of magnification 20,000 indicating the metal structure in the cross section of FIG. 2.

The photo in FIG. 1 is a microphotograph of experiment No. 10 in which the white grains represent carbides. This is an electron microphotograph of magnification 20,000 and corroded for approximately 15 seconds with a corrosive solution (4% picric acid alcohol solution), clearly showing the shape of the carbides. The microphotographs given in FIG. 2 and FIG. 3 represent the cross section and the longitudinal section of the experiment No. 11 respectively.

Next, we measured tensile strength, fracture elongation, reduction of area, fatigue strength ratio and knot strength ratio as mechanical properties of extra fine wire after wire drawing in the above experiments. Table 5 indicates the result of those measurements.

In the table, fatigue strength ratio is a ratio of limit fatigue strength (kgf/mm$^2$) to tensile strength of individual wires, limit fatigue strength being defined as the stress of $10^7$ times of repetition at 20° C. performed by using a Hunter's fatigue tester and is expressed in index against the fatigue strength ratio of the wire of experiment No. 15.

Knot strength ratio is a ratio (%) of knot strength to tensile strength, and it is more advantageous if the value in Table 5 is larger.

No measured value is indicated for super extra fine wires (experiments Nos. 2, 5, 8, 11, 14) for which the measurement of limit fatigue strength is particularly difficult and for fairly large wires (experiments Nos. 17, 18) for which the comparison is not suitable.

TABLE 5

| | Physical properties after final wire drawing | | | | |
|---|---|---|---|---|---|
| Experiment No. | Tensile strength kgf/mm$^2$ | Elongation % | Reduction of area % | Fatigue strength ratio, Index | Knot strength ratio % |
| 1 | 230 | 3.1 | 54 | 80 | 58.5 |
| 2 | 280 | 2.8 | 48 | — | 57.6 |
| 3 | 310 | 2.9 | 52 | 105 | 59.8 |
| 4 | 285 | 3.2 | 53 | 100 | 61.3 |
| 5 | 340 | 2.9 | 54 | — | 59.8 |
| 6 | 345 | 2.8 | 51 | 110 | 61.0 |
| 7 | 350 | 2.9 | 52 | 110 | 60.7 |
| 8 | 360 | 3.0 | 51 | — | 61.0 |
| 9 | 365 | 2.7 | 48 | 120 | 60.3 |
| 10 | 310 | 2.9 | 52 | 115 | 61.4 |
| 11 | 430 | 3.0 | 45 | — | 58.1 |
| 12 | 345 | 2.8 | 47 | 110 | 58.6 |
| 13 | 390 | 2.8 | 51 | 105 | 59.3 |
| 14 | 410 | 2.7 | 46 | — | 58.0 |
| 15 | 280 | 2.9 | 41 | 100 | 53.1 |
| 16 | 290 | 2.8 | 46 | 97 | 55.0 |
| 17 | 152 | 2.3 | 35 | — | 47.3 |
| 18 | 175 | 2.1 | 32 | — | 45.1 |

From Tables 4 and 5, we confirmed the following:

In experiments Nos. 15, 16 which consisted in drawing wires having a pearlite structure, the tensile strength was 280 kgf/mm$^2$ and 290 kgf/mm$^2$, the elongation was 2.9% and 2.8%, the reduction of area was 41% and 46%, the fatigue life was 100 and 97 and the knot strength ratio was 53.1% and 55.0% respectively with wire diameters of 0.20 mm and 0.32 mm.

In experiments Nos. 17, 18 which consisted in drawing wires having a tempered martensite structure found in the conventional spring material, etc., the tensile strength was 152 kgf/mm$^2$ and 175 kgf./mm$^2$, the elongation was 2.3% and 2.1%, the reduction of area was 35% and 32% and the knot strength ratio was 47.3% and 45.1% respectively with wire diameters of 1.75 mm and 1.50 mm.

On the contrary, in experiments Nos. 3, 5–14 of the present invention, the tensile strength was 310–430 kgf/mm$^2$, the elongation was 2.97–3.0%, the reduction of area was 45–54%, the fatigue life was 105–120 and the knot strength ratio was 58.0–61.4, showing a clear supremacy over the conventional examples.

Moreover, in experiments Nos. 1, 2, 4 which are reference examples of the same wire diameter with that of the present invention and submitted to hardening and tempering before wire drawing, the tensile strength was 230–285 kgf/mm$^2$ and the fatigue life was 80–100, proving them to be inferior to the present invention.

The causes of such differences are believed to be the difference in the shape of carbides in the metal structure after wire drawing and the degree of carbon content of the wire rods.

In the extra fine metal wire of the present invention, the excellent drawability in the final wire drawing is also of great importance. The main objectives of wire drawings are to obtain fine wires and to improve the tensile strength of the wire. However, if the tensile strength gets too large, breaking of wire takes place frequently during the wire drawing, making wire drawing impossible. For that reason, you have to perform heat treatment (patenting, etc.) again and then wire drawing. In that case, if the drawability is poor, it becomes impossible to take a large drawing strain and heat treatment must be repeated many times. The number of dies also considerably increases. The patenting for this kind of wire is performed with a heating temperature of approximately 1,000° C. and a lead temperature of approximately 550° C. As the wire diameter gets smaller, the temperature control becomes more difficult and breaking of wire takes place frequently even in the lead bath process. Usually, patenting is almost impossible with a wire of a diameter of no more than 0.6 mm.

On the contrary, with a material of excellent workability in wire drawing as that of the present invention, it is possible to take a large drawing strain reduce the number of times of patenting and perform wire drawing even with fine wires of high strength, thus enabling a sharp reduction in the manufacturing cost.

Moreover, (the specimens of) experiments Nos. 7–9, 11, 13, 14 prepared by using the heat treating method which consists in first heating wire rods of a diameter of 0.1–1.6 mm at a temperature of 750° C.–805° C., oil hardening them and then tempering them at a temperature of 300° C.–550° C. to provide them with a tensile strength of 130 kgf/mm$^2$ or over have an about circular shape of carbides including a lot of carbides in shape A. Their tensile strength ranged from 350 to 430 kgf/mm$^2$ providing that they are high-strength extra fine wires of more excellent properties.

If you perform the said heat treatment by using a wire rod which was submitted to patenting in the intermediate heat treatment and then to wire drawing, the grain size of austenite and the shape of carbides can be made more homogenous and fine.

Moreover, the said material submitted to heat treatment can be transformed into austenite in a short time because the carbides melt well in austenitizing if you use a material submitted to wire drawing after patenting heat treatment, and this is effective for the refining of carbides after heat treatment. If the diameter gets larger, the heating time required for homogenous austenitizing gets longer and the structure in the peripheral part is liable to get coarse. In such a case, rapid heating by induction heating is effective from the viewpoint of control.

EXAMPLE 2

Next, we will show an example of experiment No. 6 in which the high-strength extra fine metal wire of the present invention was used as tire cord. Before the final wire drawing, the (material of experiment No. 6) was finished by performing brass plating of a thickness of 0.8$\mu$ on the surface. We produced a tire cord of 1×5×0.20 by twisting 5 pieces of such element wire. The mechanical properties of this tire cord were as shown in Table 6. As compared with a conventional tire cord of 1×5×0.20 for reference, this product proved to be superior in tensile strength and fatigue resistance. Also when it is used for the belt section for the carcass section of the tire, it is easily conceivable that this tire cord will greatly contribute to reduction of weight, long life and improvement of driving comfort of the tire.

TABLE 6

| | Conventional steel cord | Steel cord according to the present invention |
|---|---|---|
| Construction of twist | 1 × 5 × 0.20 | 1 × 5 × 0.20 |
| Twisting direction | S | S |
| Twist pitch | 10.0 | 10.0 |
| Cord diameter (mm) | 0.55 | 0.55 |
| Breaking load of cord (kg) | 42.3 | 52.1 |
| Comparison of fatigue resistance (3-point pulley system) | 100 (standard) | 112 |

EXAMPLE 3

We manufactured a wire saw for cutting silicon wafer (by using) the high-strength extra fine metal wire of the present invention in experiment No. 11.

Before the final wire drawing of experiment No. 6 in the Table, the (material wire rod) was brass plated on the surface and submitted to wire drawing in the same way (as the final wire drawing).

Figure 4:
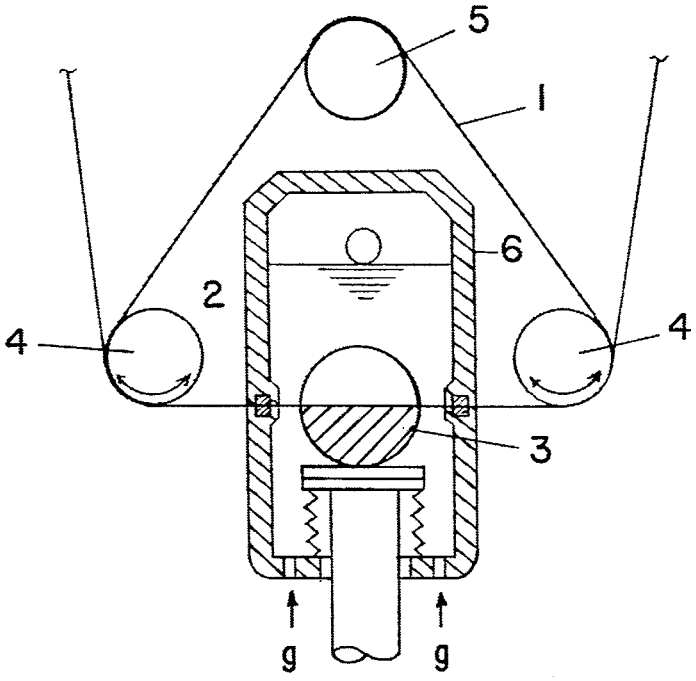
FIG. 4 is an explanatory drawing indicating the wire saw using a high-strength extra fine metal wire of the present invention.

In this example, the work 3 is dipped in a refrigerant solution 2 mixed with abrasive grains supplied from below as indicated in FIG. 4 and moved at a high speed while pushing the wire 1 at the cutting position of single crystal of silicon to be cut. 4, 5 in the figure represent pulleys.

By comparing the results of this cutting with piano wire and stainless wire, we could confirm improvements in processing speed and accuracy as well as reduction of working loss. This is probably because the high-strength extra fine metal wire of the present invention well preserves its properties with little breaking after wire drawing thanks to its excellent workability in wire drawing, is finer and is excellent in both strength and tenacity.

Therefore, we could confirm that the high-strength extra fine metal wire of the present invention is also effective when it is used as wire saw to be adopted for cutting, grooving or grinding, etc. of precision parts, electronic parts, various semi-conductors, diamond dies, etc.

EXAMPLE 4

So far, there are piano wire, stainless steel wire, tungsten wire, etc. as metal wires used for fishing line. Generally, fishing lines are requested to have such basic characteristics as small water resistance, little deterioration in water such as sea water or river water, flexibility, etc. However, the fishlines made of conventional metal wire have such problems as low knot strength ratio especially for binding a fishline with another or with a fishing hook, easy breaking or poor curling characteristic in the case of working of an impact force on the fishing line. The fishline using the high-strength extra fine metal wire of the present invention has the above-mentioned basic characteristics and has solved the problems of the conventional products.

We bundled 7 metal wires of experiment No. 8, twisted them into a stranded wire and then covered it with a synthetic resin of a thickness of about 8 μm to manufacture a fishline. We also manufactured a similar fishline using a conventional piano wire for the sake of comparison and compared the two products with each other. As a result, the product of the present invention showed a higher stranded wire strength and was also higher by about 10% in knot strength ratio. Moreover, it sharply decreased the production of kinds and curls.

By the way, this invention can also be adopted for rubber reinforcements such as belt cord, hose wire, bead wire, etc., plastic reinforcements, shielding material for electromagnetic wave, needle material, spring material, wire rope, miniature rope, wire gauze, extra fine tube for medical use, woven fabric, hollow material, electric communication, cable, optical fiber cable, ski board reinforcement, glass frame, various electrode wires, etc. in addition to the said examples.

What is claimed is:

1. A high-strength extra fine metal wire of a diameter of 0.01–0.50 mm containing 0.60 wt %–1.20 wt% carbon, having a tensile strength no less than 300 kgf/mm$^2$ and being a metal structure obtained by drawing tempered martensite, said metal structure comprising a bundle of carbides of a shape satisfying the following formula in a cross section thereof:

$$l/w \leqq 2.5,\ S \leqq 150 \times 10^{-4}\ \mu m^2$$

where, l is the length of the carbide in the longitudinal direction, w is the length of the carbide in the direction of width S is the mean sectional area of the carbide.

2. The high-strength extra fine metal wire as defined in claim 1, wherein no less than 90% of carbides are of an about circular shape with a length of $800 \times 10^{-4}\ \mu m^2$ or under in the direction of width in the cross section and have a tensile strength no less than 350 kgf/mm$^2$.

* * * * *